US006318095B1

(12) United States Patent
Guo et al.

(10) Patent No.: US 6,318,095 B1
(45) Date of Patent: Nov. 20, 2001

(54) METHOD AND SYSTEM FOR DEMAND DEFROST CONTROL ON REVERSIBLE HEAT PUMPS

(75) Inventors: Charles Z. Guo, Fayetteville, NY (US); Raymond A. Rust, Jr., Gosport, IN (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 09/680,696

(22) Filed: Oct. 6, 2000

(51) Int. Cl.[7] ..... F25D 21/06
(52) U.S. Cl. ..... 62/80; 62/156
(58) Field of Search ..... 62/80, 81, 151, 62/155, 156, 234, 140; 165/231, 232, 233

(56) References Cited

U.S. PATENT DOCUMENTS

| | | | | |
|---|---|---|---|---|
| 4,882,908 | * | 11/1989 | White | 62/156 X |
| 5,179,841 | * | 1/1993 | Phillips et al. | 62/156 X |
| 5,727,395 | | 3/1998 | Guo et al. | 62/156 |
| 5,797,273 | | 8/1998 | Guo et al. | 62/156 |
| 5,927,083 | | 7/1999 | Guo et al. | 62/80 |
| 6,205,800 | * | 3/2001 | Topper et al. | 62/155 X |

* cited by examiner

*Primary Examiner*—Harry B. Tanner
(74) *Attorney, Agent, or Firm*—Wall Marjama & Bilinski

(57) ABSTRACT

A control processor controls an outdoor coil defrost cycle on a reversible heat pump by continuously monitoring the difference between the outdoor coil temperature and the outdoor air temperature. When specified preconditions are met and this difference exceeds a target value, the defrost cycle is initiated.

12 Claims, 6 Drawing Sheets

METHOD AND SYSTEM FOR DEMAND DEFROST CONTROL ON REVERSIBLE HEAT PUMPS

FIELD OF THE INVENTION

This invention pertains to the field of reversible heat pumps, and in particular, to controlling the coil defrosting cycle while in heating mode.

BACKGROUND OF THE INVENTION

Heat pump systems use a refrigerant to carry thermal energy between a relatively hotter side of a circulation loop to a relatively cooler side of the circulation loop. Compression of the refrigerant occurs at the hotter side of the loop, where a compressor raises the temperature of the refrigerant. Evaporation of the refrigerant occurs at the cooler side of the loop, where the refrigerant is allowed to expand, thus resulting in a temperature drop. Thermal energy is added to the refrigerant on one side of the loop and extracted from the refrigerant on the other side, due to the temperature differences between the refrigerant and the indoor and outdoor mediums, respectively, to make use of the outdoor mediums as either a thermal energy source or a thermal energy sink. In the case of an air to water heat pump, outdoor air is used as a thermal energy source while water is used as a thermal energy sink.

The process is reversible, so the heat pump can be used for either heating or cooling. Residential heating and cooling units are bidirectional, in that suitable valve and control arrangements selectively direct the refrigerant through indoor and outdoor heat exchangers so that the indoor heat exchanger is on the hot side of the refrigerant circulation loop for heating and on the cool side for cooling. A circulation fan passes indoor air over the indoor heat exchanger and through ducts leading to the indoor space. Return ducts extract air from the indoor space and bring the air back to the indoor heat exchanger. A fan likewise passes ambient air over the outdoor heat exchanger, and releases heat into the open air, or extracts available heat therefrom.

These types of heat pump systems operate only if there is an adequate temperature difference between the refrigerant and the air at the respective heat exchanger to maintain a transfer of thermal energy. For heating, the heat pump system is efficient provided the temperature difference between the air and the refrigerant is such that the available thermal energy is greater than the electrical energy needed to operate the compressor and the respective fans. For cooling, the temperature difference between the air and the refrigerant generally is sufficient, even on hot days.

Under certain operating conditions, frost builds up on a coil of the heat pump. The speed of the frost build-up is strongly dependent on the ambient temperature and the humidity ratio. Coil frosting results in lower coil efficiency while affecting the overall performance (heating capacity and coefficient of performance) of the unit. From time to time, the coil must be defrosted to restore the unit efficiency. In most cases, coil defrosting is achieved through refrigerant cycle inversion. The time at which the coil defrosting occurs impacts the overall efficiency of the unit, since the hot refrigerant in the unit, which provides the desired heat, is actually cooled during coil defrosting.

Conventional units typically use a fixed period between defrosting cycles, irrespective of how much frosting actually occurs within the fixed period. In order to optimize the unit performance while in the heating mode, it is necessary to optimize the time at which coil defrosting occurs.

SUMMARY OF THE INVENTION

Briefly stated, a control processor controls an outdoor coil defrost cycle on a reversible heat pump by continuously monitoring the difference between the outdoor coil temperature and the outdoor air temperature. When specified preconditions are met and this difference exceeds a target value, the defrost cycle is initiated.

According to an embodiment of the invention, a method for controlling a coil defrosting cycle in a reversible heat pump system using a refrigerant cycle includes the steps of (1) monitoring an outdoor coil temperature of an outdoor coil of the heat pump system; (2) monitoring an outdoor air temperature in a vicinity of the outdoor coil; (3) determining a maximum allowable difference between the outdoor air temperature and the outdoor coil temperature; and (4) defrosting the coil when a dynamically determined difference between the outdoor air temperature and the outdoor coil temperature exceeds the maximum allowable difference for a predetermined amount of time and predetermined conditions of the system are met.

According to an embodiment of the invention, a system for controlling a coil defrosting cycle in a reversible heat pump system using a refrigerant cycle includes means for monitoring an outdoor coil temperature of an outdoor coil of the heat pump system; means for monitoring an outdoor air temperature in a vicinity of the outdoor coil; means for determining a maximum allowable difference between the outdoor air temperature and the outdoor coil temperature; and means for defrosting the coil when a dynamically determined difference between the outdoor air temperature and the outdoor coil temperature exceeds the maximum allowable difference for a predetermined amount of time and predetermined conditions of the system are met.

DETAILED DESCRIPTION OF THE PREFERRED EMBODIMENT

Figure 1:
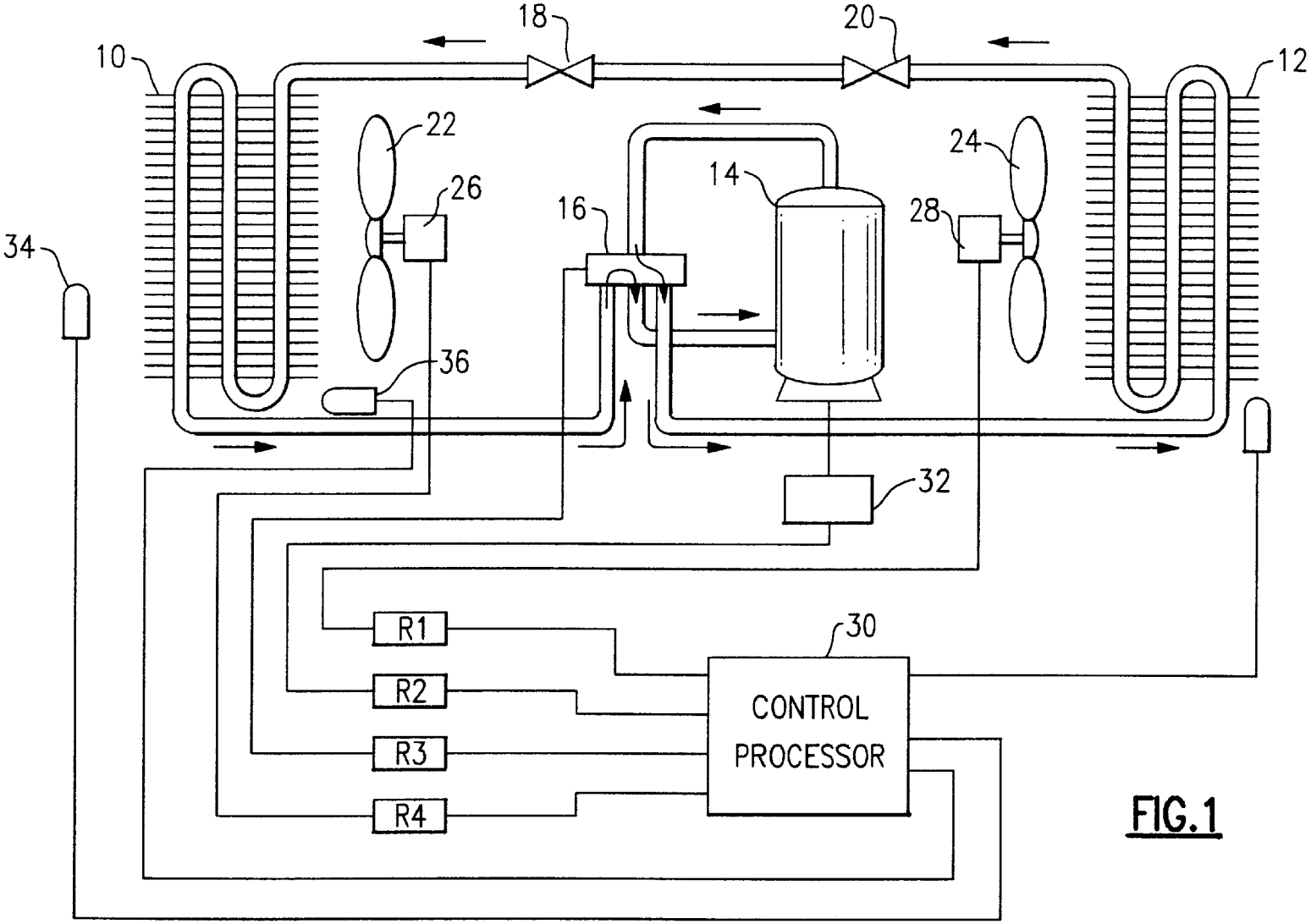
FIG. 1 shows a schematic diagram of a reversible heat pump system.

Referring to FIG. 1, a heat pump system includes an indoor coil 12 and an outdoor coil 10 operatively connected with a compressor 14 and a reversing valve 16 located therebetween. Also located between outdoor and indoor coils 10, 12 are a pair of bi-flow expansion valves 18 and 20, which allow refrigerant to flow in either direction as a result of the setting of reversing valve 16. All of the aforementioned components operate in a conventional manner so as to allow the heat pump system to provide heating to an indoor space while operating in a heating mode.

An outdoor fan 22 provides a flow of air over outdoor coil 10 whereas an indoor fan 24 provides a flow of air over indoor coil 12. Outdoor fan 22 is driven by a fan motor 26 while indoor fan 24 is driven by a fan motor 28. The drive speeds of the fans are preferably commanded by a control processor 30 that controls the fan motors through relay drives R1 and R4. Fan motor 28 is preferably controlled by relay drive R1 whereas fan motor 26 is controlled by relay drive R4. Reversing valve 16 is controlled by control processor 30 operating through relay drive R3. Compressor 14 is similarly controlled by control processor 30 acting through relay drive R2 connected to a compressor motor 32.

Referring to control processor 30, control processor 30 receives outdoor coil temperature values from a thermistor 36 associated with outdoor coil 10 and an outdoor air temperature value from a thermistor 34. Control processor 30 initiates a defrost action when certain temperature conditions indicated by thermistors 34 and 36 occur. In order for control processor 30 to detect the particular temperature conditions giving rise to a need to defrost, it is preferable that the processor perform a particular computation involving the outdoor air temperature provided by thermistor 34 and the outdoor coil temperature provided by thermistor 36. The refrigerant flow in the heating mode is shown by the arrows.

Figure 2A:
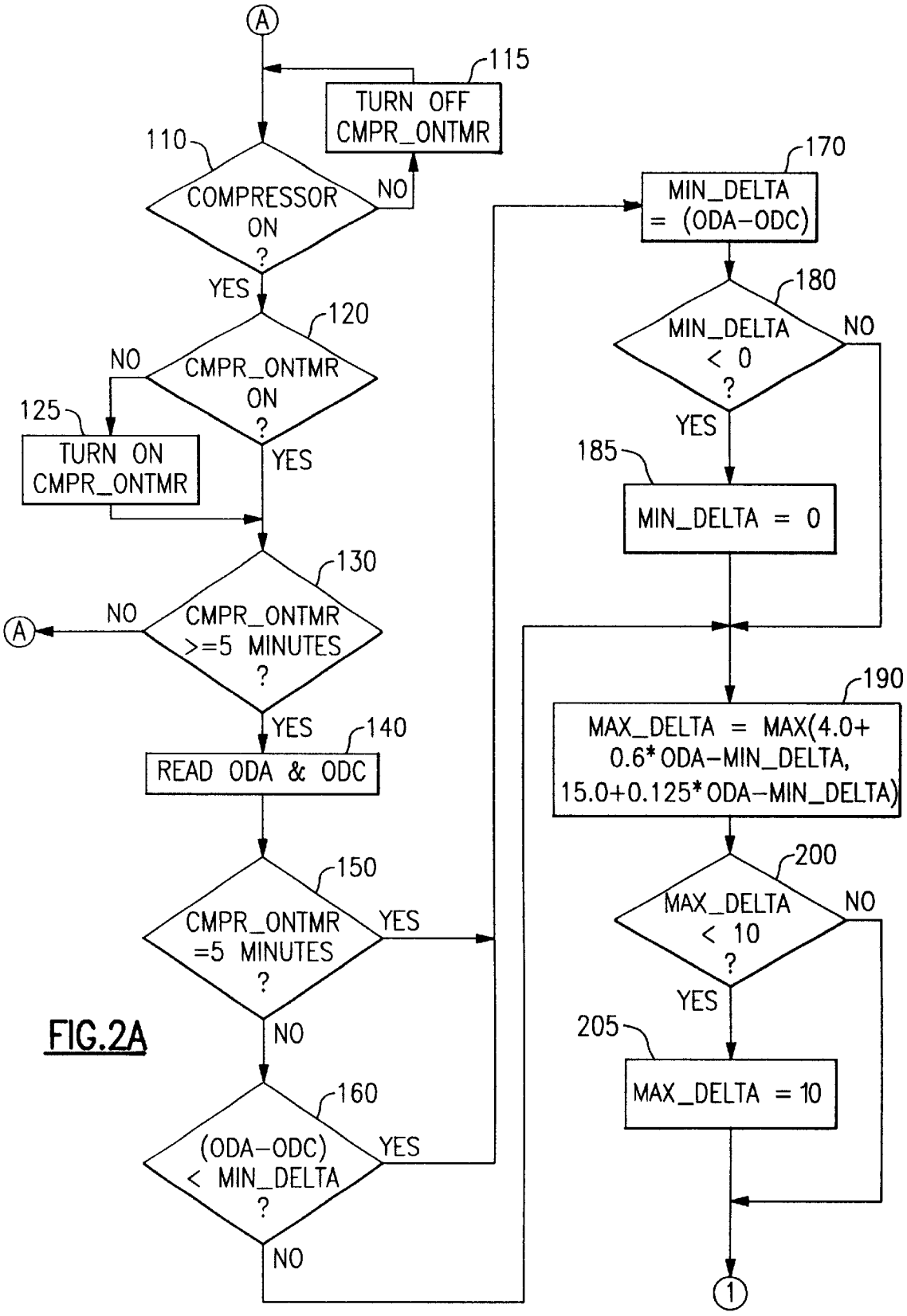
FIGS. 2A–C shows a flow chart of the method of the present invention.
Figure 2B:
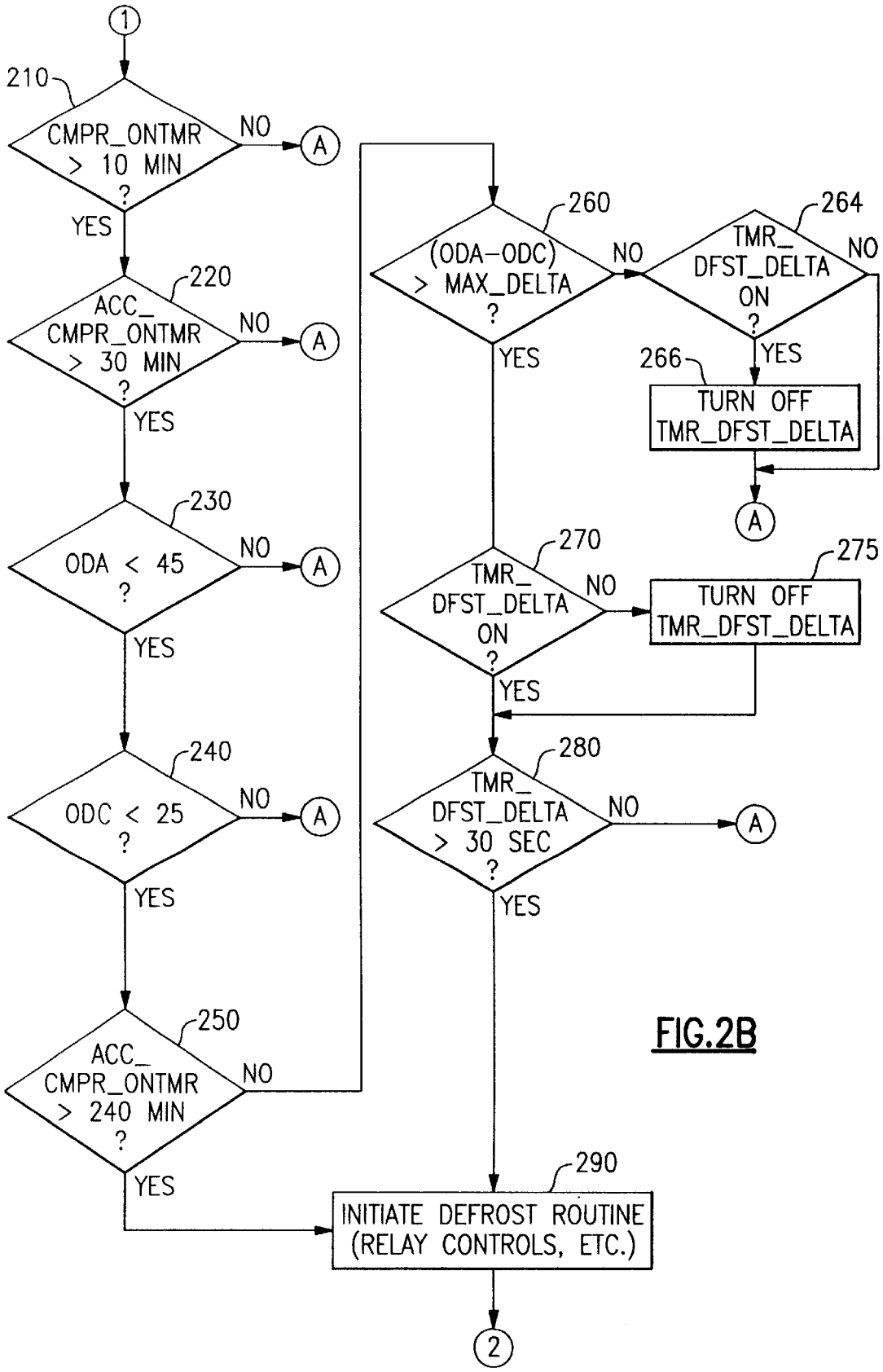
Figure 2C:
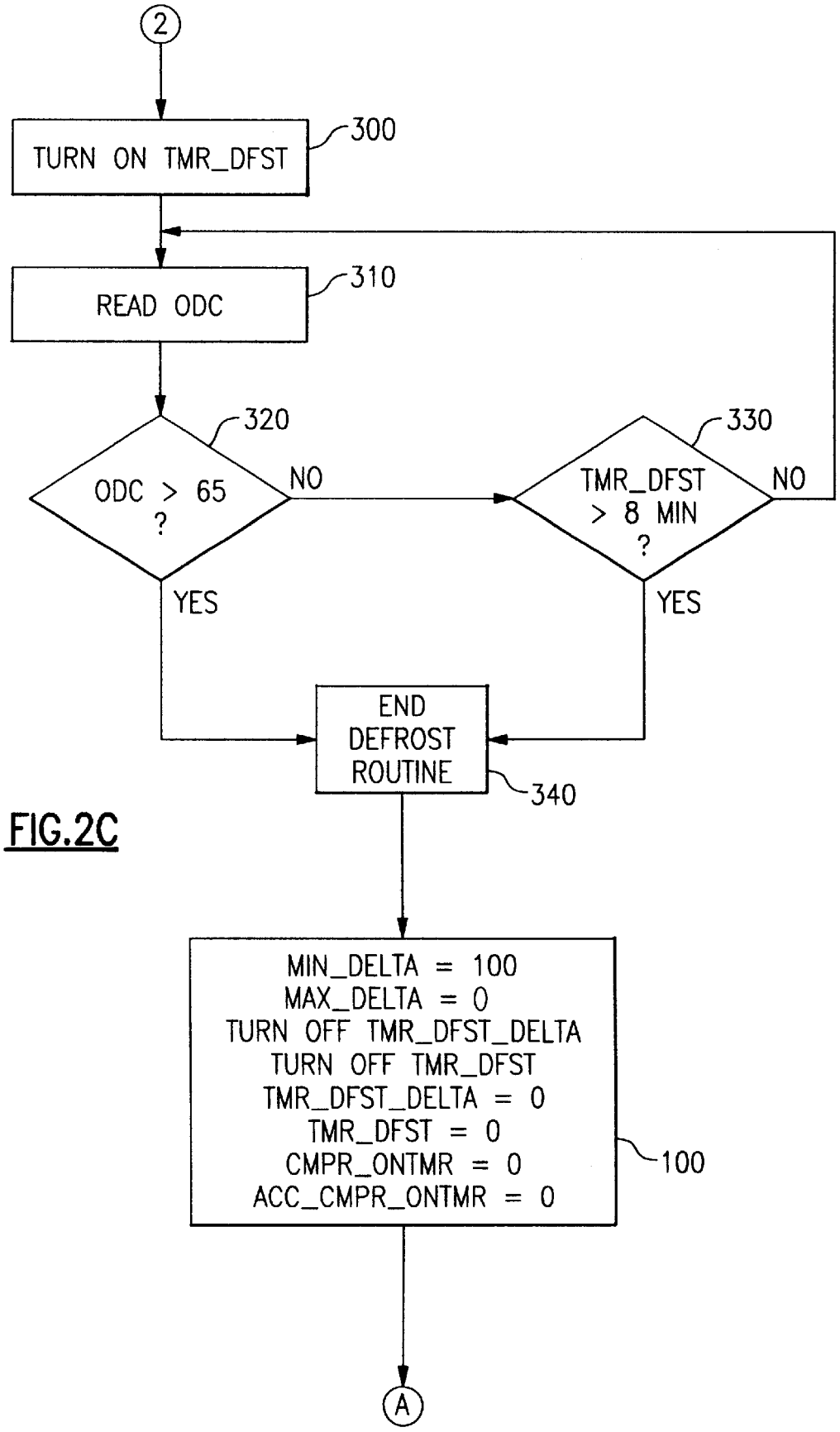
Figure 3:
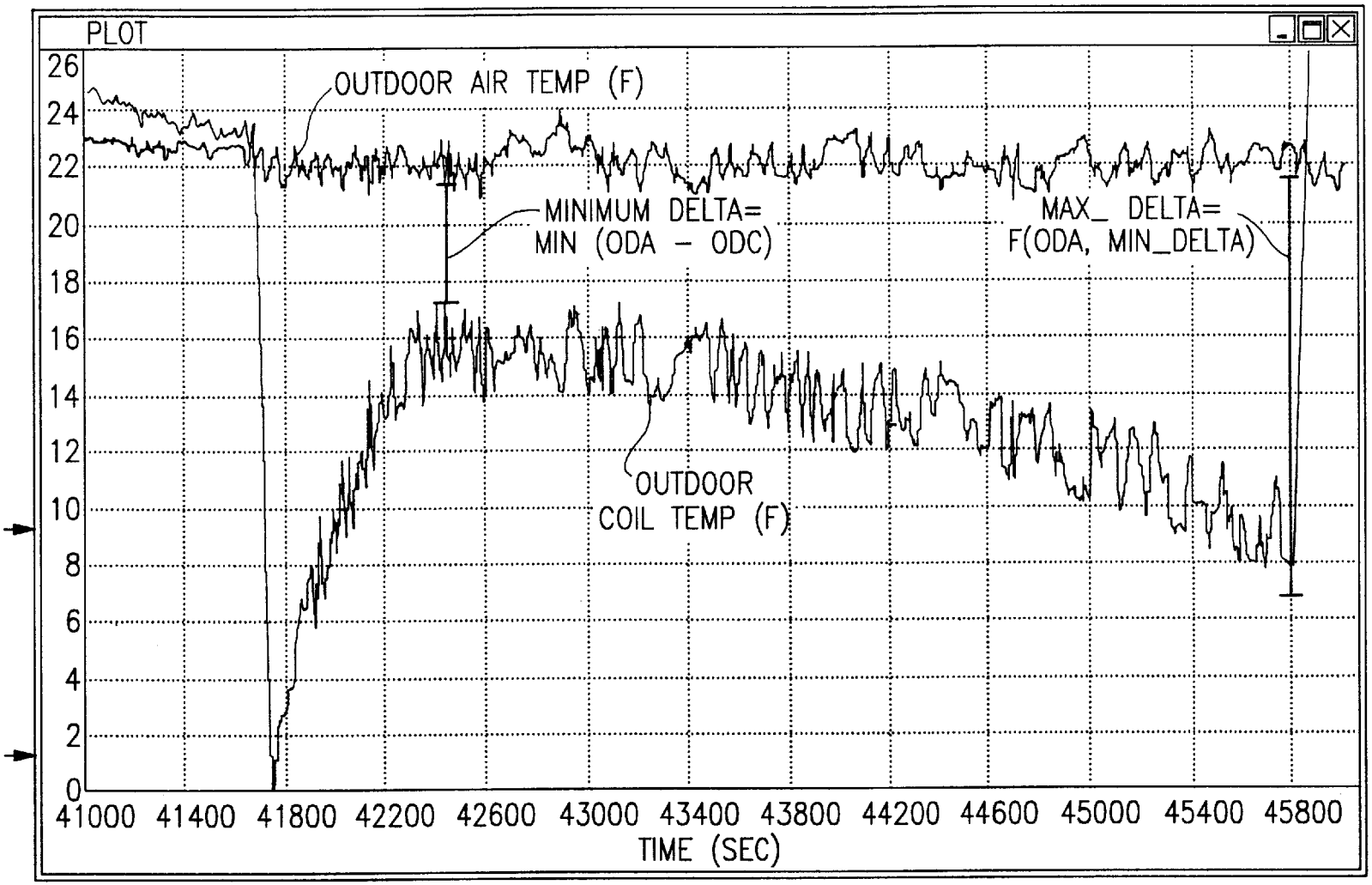
FIG. 3 shows how an outdoor air temperature and an outdoor coil temperature of a reversible heat pump system vary over time.
Figure 4:
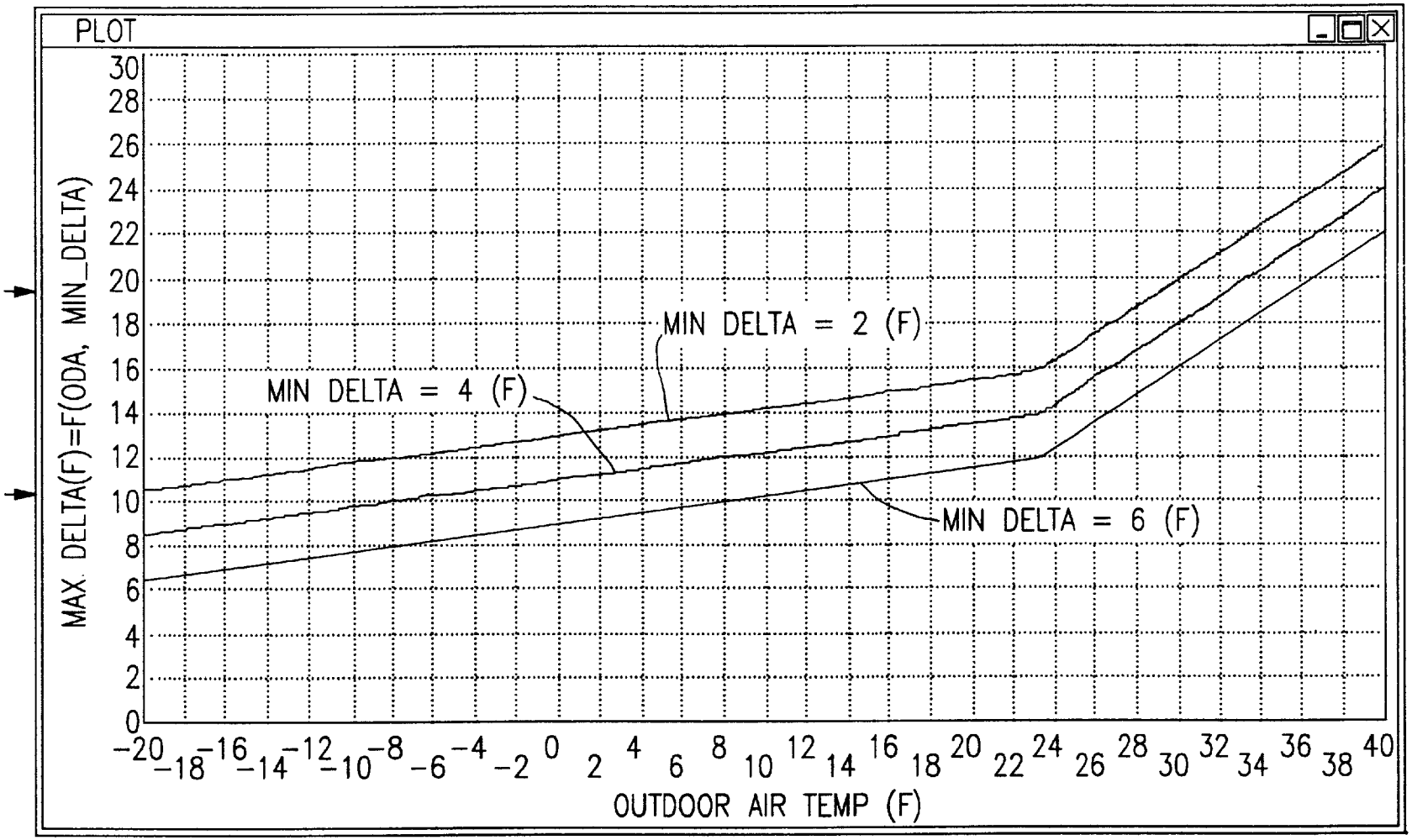
FIG. 4 shows how a maximum allowable difference behaves as a function of the outdoor air temperature and a minimum difference between the outdoor air temperature and the outdoor coil temperature.

Referring to FIGS. 2A–C, a flow chart illustrates an embodiment of the invention. The invention is based on the heat pump system thermodynamics and the outdoor air and coil temperatures. In general, the invention monitors the difference between the outdoor air temperature and the outdoor coil temperature to see if it exceeds a dynamically calculated target value. Various additional conditions have to be met before defrosting to ensure that unnecessary or insufficient defrosting does not occur.

In initial step 100, variables are initialized. The minimum delta (min_delta) is set to 100, the maximum delta (max_delta) is set to 100, the defrost delta timer and the defrost timer are turned off and their values (tmr_dfst_delta and tmr_dfst) set to zero, and the values for the continuous compressor-on time (cmpr_ontmr) and the accumulated compressor-on time (acc_cmpr_ontmr) are set to zero. Control passes to point A.

In step 110, the compressor is checked to see if it is on. If not, the compressor-on timer is turned off. If the compressor is on, the compressor-on timer is checked in step 120 to see if it is on. If not, it is turned on in step 125. The compressor-on timer is checked in step 130 to see if the compressor has been on for 5 minutes or more. This allows the heat pump system to stabilize after starting. If the compressor has not been on for 5 minutes, control passes back to point A.

Once the compressor is on for 5 minutes, the outside air temperature (ODA) and outside coil temperature (ODC) are read in step 140. When the compressor has been on for exactly 5 minutes (step 150), the value for min_delta is set to ODA−ODC in step 170. The value for min_delta is presumed to be at its minimum when the system has a clean coil, which should be after initial startup or after the last defrost cycle. If the compressor has been on for more than 5 minutes, the difference between ODA and ODC is checked to see if it should become the new min_delta. If not, control passes to step 190. After min_delta is set in step 170, it is checked to see if it is negative in step 180, and if so, it is set to zero in step 185. In step 190, the value for max_delta is set. The formula is heat pump system specific and based on testing data. That is, the formula changes for different systems. Max-delta is set to the maximum of either (4+0.6×ODA−min_delta) or (15+0.125×ODA−min_delta). Thus, max_delta is a function of the outdoor air temperature (ODA) and min_delta. An alternate formula for use with a microprocessor with limited 4-bit capabilities is max_delta=max (7.0+ODA/2−min_delta, 15+ODA/8 −min_delta). Both dividing by 2 and dividing by 8 are accomplished in binary by merely shifting bits, so floating point arithmetic is not needed.

If max_delta is less than 10 (step 200), max_delta is set to 10 in step 205. A series of conditions are checked to see if the defrost cycle should be run. These conditions are:

(a) has the compressor been continuously on for more than 10 minutes (step 210), (b) does the accumulated compressor-on time exceed 30 minutes (step 220), (c) is the outdoor air temperature less than 45 degrees F. (step 230), and (d) is the outdoor coil temperature less than 25 degrees F. (step 240)?

An optional condition is whether the outdoor fan, which normally runs continuously when the compressor is on, has been on for at least one minute. This optional condition is required only if an independent algorithm control the outdoor fan.

If all these conditions are met, the accumulated compressor on-time is checked in step 250 to see if it exceeds 240 minutes, at which time the defrosting cycle is initiated in step 290. That is, even if the max_delta is not exceeded by the difference between ODA and ODC, the defrost cycle will begin as soon as all the other conditions are met.

If the accumulated compressor-on time does not exceed 240 minutes, the invention checks to see if the difference (ODA−ODC) exceeds max_delta for more than 30 continuous seconds in steps 260 through 280. In step 260, the difference (ODA−ODC) is compared to max_delta, and if ODA−ODC is less than max_delta, control passes back to point A after the defrost delta timer is turned off if necessary. Otherwise, in steps 270 and 275, the defrost delta timer is turned on if not already on. The defrost delta timer is checked in step 280 to see if the condition of step 260 has been in effect for over 30 seconds. If not, control passes to point A. If so, the defrost cycle is initiated in step 290.

A typical defrost cycle includes overriding the system thermostat during the defrost cycle. The indoor fan speed is preferably set to follow the existing indoor fan control logic. The electric heater is set on, the compressor is energized at high speed, the reversing valve is energized, and the outdoor fan is de-energized.

After the defrost timer is turned on in step 300, the outdoor coil temperature (ODC) is read in step 310. When the outdoor coil temperature exceeds 65 degrees F. (step 320) or when the defrost cycle has been running for more than 8 minutes (step 330), the defrost cycle is ended in step 340. The defrost cycle also stops if power is lost or manually turned off. After the defrost is complete, the compressor remains energized, the reversing valve is de-energized, and the outdoor fan is turned on. The heater control and indoor fan continue to follow the existing control logic. Control then passes to the initialization step 100 to begin the entire cycle anew.

While the present invention has been described with reference to a particular preferred embodiment and the accompanying drawings, it will be understood by those skilled in the art that the invention is not limited to the preferred embodiment and that various modifications and the like could be made thereto without departing from the scope of the invention as defined in the following claims.

What is claimed is:

1. A method for controlling a coil defrosting cycle in a reversible heat pump system using a refrigerant cycle, comprising the steps of:

monitoring an outdoor coil temperature of an outdoor coil of said heat pump system;

monitoring an outdoor air temperature in a vicinity of said outdoor coil;

determining a maximum allowable difference between said outdoor air temperature and said outdoor coil temperature; and defrosting said coil when a dynamically determined difference between said outdoor air temperature and said outdoor coil temperature exceeds said maximum allowable difference for a predetermined amount of time and predetermined conditions of said system are met.

2. A method according to claim 1, where in said step of defrosting occurs if an accumulated compressor-on time exceeds a specified amount of time and said predetermined conditions of said system are met.

3. A method according to claim 1, where in said step of determining said maximum allowable difference includes:

determining a minimum difference between said outdoor air temperature and said outdoor coil temperature;

adding a first constant to a first percentage of said outdoor air temperature and subtracting said minimum difference to obtain a first possible value;

adding a second constant to a second percentage of said outdoor air temperature and subtracting said minimum difference to obtain a second possible value; and selecting a larger of said first and second possible values as said maximum allowable difference.

4. A method according to claim 3, wherein said first constant is 4.0 degrees F., said first percentage is 60 percent, said second constant is 15 degrees, and said second percentage is 12.5 percent.

5. A method according to claim 3, wherein said first constant is 7.0 degrees, said first percentage is 50 percent, said second constant is 15 degrees, and said second percentage is 12.5 percent.

6. A method according to claim 1, further comprising the steps of:

monitoring said outdoor coil temperature; and stopping said step of defrosting when said outdoor coil temperature exceeds a predetermined temperature or when a period of said defrosting exceeds a predetermined time.

7. A system for controlling a coil defrosting cycle in a reversible heat pump system using a refrigerant cycle, comprising:

means for monitoring an outdoor coil temperature of an outdoor coil of said heat pump system;

means for monitoring an outdoor air temperature in a vicinity of said outdoor coil;

means for determining a maximum allowable difference between said outdoor air temperature and said outdoor coil temperature; and means for defrosting said coil when a dynamically determined difference between said outdoor air temperature and said outdoor coil temperature exceeds said maximum allowable difference for a predetermined amount of time and predetermined conditions of said system are met.

8. A system according to claim 7, wherein said means for defrosting includes means for defrosting said coil if an accumulated compressor-on time exceeds a specified amount of time and said predetermined conditions of said system are met.

9. A system according to claim 7, wherein said means for determining said maximum allowable difference includes:

means for determining a minimum difference between said outdoor air temperature and said outdoor coil temperature;

means for adding a first constant to a first percentage of said outdoor air temperature and subtracting said minimum difference to obtain a first possible value;

means for adding a second constant to a second percentage of said outdoor air temperature and subtracting said minimum difference to obtain a second possible value; and means for selecting a larger of said first and second possible values as said maximum allowable difference.

10. A system according to claim 9, wherein said first constant is 4.0 degrees F., said first percentage is 60 percent, said second constant is 15 degrees, and said second percentage is 12.5 percent.

11. A system according to claim 9, wherein said first constant is 7.0 degrees, said first percentage is 50 percent, said second constant is 15 degrees, and said second percentage is 12.5 percent.

12. A system according to claim 7, further comprising:

means for monitoring said outdoor coil temperature; and means for stopping said step of defrosting when said outdoor coil temperature exceeds a predetermined temperature or when a period of said defrosting exceeds a predetermined time.

* * * * *